US006276859B1

(12) United States Patent
Hsu

(10) Patent No.: US 6,276,859 B1
(45) Date of Patent: Aug. 21, 2001

(54) ADHESIVE TAPE PEN

(76) Inventor: Jeou-En Hsu, 5F, No. 14, Alley 8, Lane 45, Pao-Hsing Rd., Tapei Hsien City (TW)

( * ) Notice: Subject to any disclaimer, the term of this patent is extended or adjusted under 35 U.S.C. 154(b) by 0 days.

(21) Appl. No.: 09/711,306

(22) Filed: Nov. 14, 2000

(51) Int. Cl.[7] ..... B43K 29/00; B43K 29/12

(52) U.S. Cl. ..... 401/195; 15/435; 206/38; 206/216; 206/394; 206/411; D19/36

(58) Field of Search ..... 401/195; 15/435; D19/36; 206/38, 216, 389, 391, 394, 411

(56) References Cited

U.S. PATENT DOCUMENTS 2,601,650 * 6/1952 Walter et al. ..... D19/36 X
4,812,069 * 3/1989 White et al. ..... 401/195
4,989,801 * 2/1991 Thomas et al. ..... 401/195 X

* cited by examiner

*Primary Examiner*—Gregory L. Huson
*Assistant Examiner*—Kathleen J. Prunner
(74) *Attorney, Agent, or Firm*—Bacon & Thomas, PLLC

(57) ABSTRACT

An adhesive tape pen, comprises essentially a pen casing, a pen clip, adhesive tape rolls and an ink cartridge. The adhesive tape rolls are provided within the pen casing, and are fixed within the pen casing by a central shaft in a manner that the rolls can rotate by an external pulling force. A slit is provided in the pen casing for cutting the adhesive tape. The ink cartridge can be exposed by rotation of the front portion of the pen casing and thus can likewise be used for writing. The adhesive tape pen has functions of writing and tape sticking.

4 Claims, 4 Drawing Sheets

ADHESIVE TAPE PEN

BACKGROUND OF THE INVENTION

1. Field of the Invention

The invention relates to an adhesive tape pen, and in particular, to a combination of an adhesive and a pen, which has the convenience of writing together with using of the adhesive tape and is stationery without wasting space.

2. Description of the Prior Art

A pen is essential stationery in the daily life. A pen is always provided with a clip for holding the pen on the pocket of the user so that the user can carry the pen and use it at any time. Other small stationery such as, an adhesive tape, gem clip, rubber eraser and the like may be used sometime, however, due to their small size, they might be lost and lead to trouble as no stationery can be used when the user wants to use them. Accordingly, it is desirable to combine common stationery with a pen such that, when the user writes, other stationery can be used at hand, too.

Further, under the trend of the modem society, articles brought along is desirably to be lighter and more delicate to meet the requirement of convenience and multiple function as well as to have a fashionable design. In view of the foregoing, the inventor aims to improve and innovate, and, after an intensive and persistent study, develops successfully the adhesive tape pen of the invention.

SUMMARY OF THE INVENTION

Accordingly, one object of the invention is to provide an adhesive tape pen characterized in that the length of the ink cartridge is adjusted slightly to provide a space for accommodating an article, wherein said space is provided with a central shaft for fixing an adhesive tape within the pen casing in a manner that said adhesive tape can be rotated through a pulling force, and with such a configuration, the user can bring a pen along with other customary tools.

Another object of the invention is to provide an adhesive tape pen characterized in that a space for accommodating an article is provided in the pen casing without impairing the function of the pen while increasing further its added value.

Yet another object of the invention is to provide an adhesive tape pen characterized in that the user can stick and fix a written note to prevent it from being lost accidentally under an air circulating situation.

Still yet another object of the invention is to provide an adhesive tape pen characterized in that it can be used to stick a written note in a handy manner.

The above-mentioned objects can be achieved by an adhesive pen consisting of a pen casing, a pen clip, an adhesive tape and an ink cartridge; wherein said adhesive tape is provided and fixed in said pen casing by means of a central shaft in a manner that said adhesive tape can be rotated through a pulling force; wherein a slit having a function of cutting a length of said adhesive tape is provided on said pen casing; and wherein, said ink cartridge can extend out of said pen casing via the rotation of the lower part of said pen and likewise has a function of writing.

BRIEF DESCRIPTION OF THE DRAWINGS

The drawings disclose an illustrative embodiment of the present invention, which serves to exemplify the various advantages and objects hereof, and are as follows.

REPRESENTATIVE SYMBOLS OF THE MAIN ELEMENTS

Figure 1:
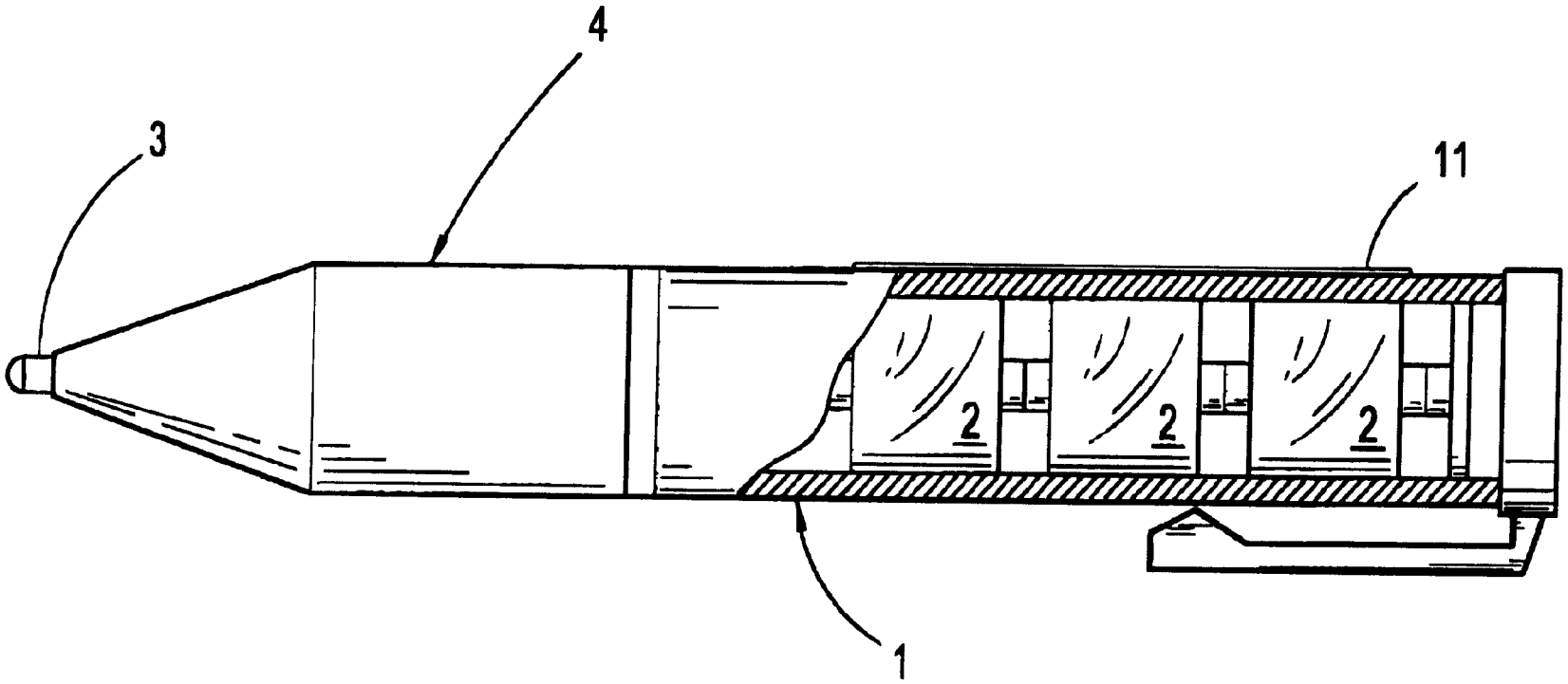
FIG. 1 is a schematic view showing the action of the adhesive tape pen according to the invention.

1 Pen casing
11 Slit
2 Adhesive tape roll
21 Sliding sleeve
3 Ink cartridge
31 Male thread
4 Front portion
5 Central shaft
51 Fixing gear thread
52 Fixing gear thread
6 Rear cap
61 Gear thread
7 Pen casing
71 Hollow rotating shaft
72 Hollow fixing seat
721 Engaging part
73 Adhesive tape roll
74 Ratchet
75 Fixing shaft
76 Push part
77 Slit
771 Notch
78 Ink cartridge
80 Front portion
81 Rear cap

DETAILED DESCRIPTION OF THE PREFERRED EMBODIMENT

Referring to FIG. 1, a schematic view shows an embodiment of the adhesive tape pen according to the invention, wherein the pen casing is illustrated in a transparent form Within the pen casing 1, several adhesive tape rolls 2 are provided separately and each of them can be drawn independently out of the pen casing by an external pulling force in a maner that the rotation of each adhesive tape roll 2 can not interfere with the de-winding of other adhesive tape rolls. A slit 11 is provided on the outside wall of the pen casing 1 to cut a length of the adhesive tape as it is drawn out. The ink cartridge 3 in the pen casing 1 can be extended out by means of a rotating device provided at the front portion 4, and then used for writing.

Figure 2:
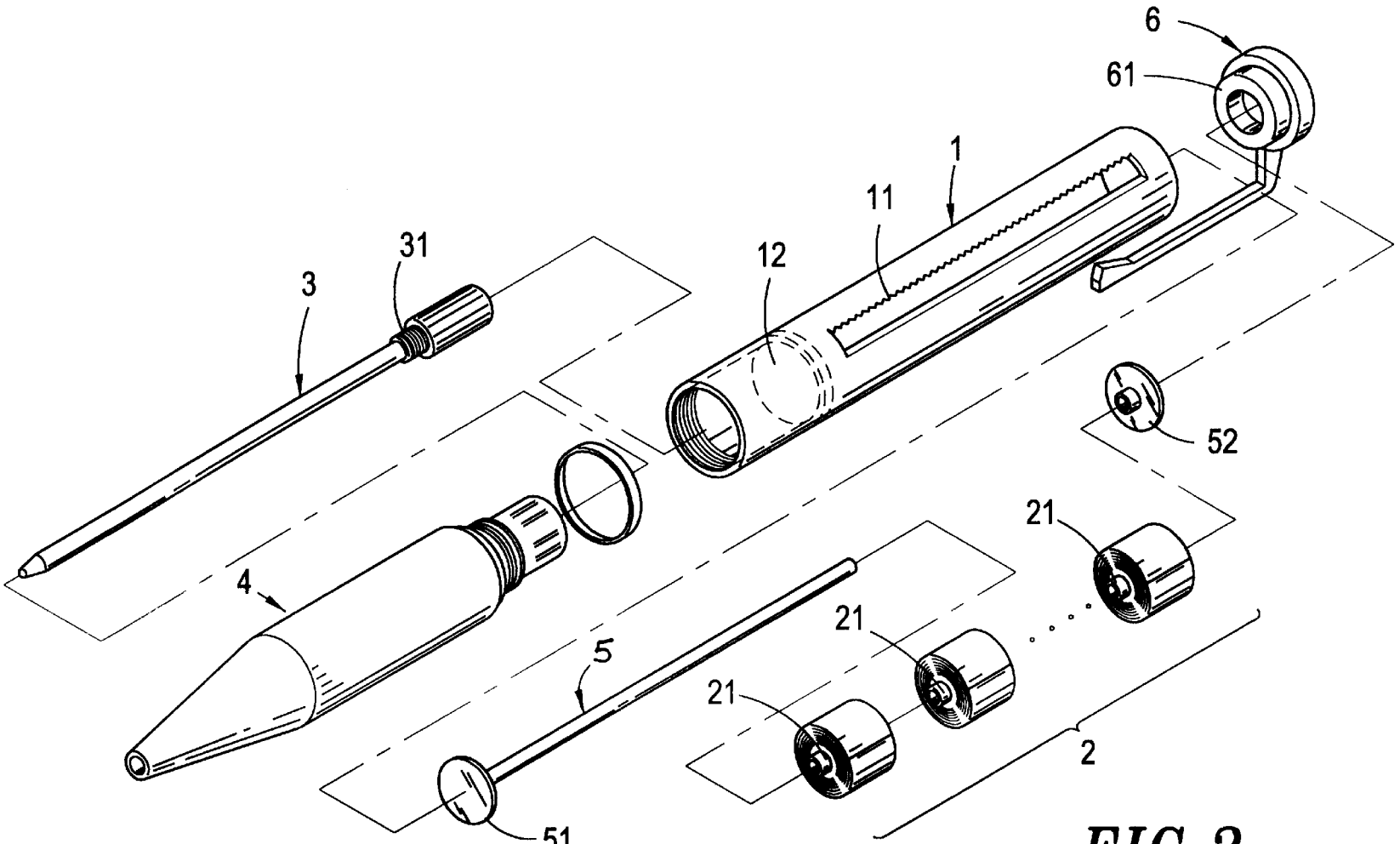
FIG. 2 is an exploded schematic view of the adhesive tape pen according to the invention.

Referring to FIG. 2, the adhesive tape pen of the invention comprises following constitutive elements: a front portion 4 allowing the ink cartridge 3 to expose its writing part, and being provided with a female thread on its inside edge (not shown) for engaging with a male thread 31 provided on the ink cartridge 3 such that said in cartridge 3 can expose its writing tip by means of a rotation device provided on said front portion 4; a pen casing 1, in a form of a hollow tube, having a slightly outward protruding slit 11 provided on an appropriate site thereof, and provided further with a gear thread 12 on its front end; a central shaft 5, being provided through the central portion of said pen casing 1 and being used mainly for fixing the adhesive tape roll 2, wherein fixing gear threads 51, 52 are provided on both of its ends for engaging stably with said gear thread 12 on said pen casing and with a gear thread 61 on the rear cap 6, respectively, in order to provide a good operation situation for the user to draw out readily the adhesive tape; several adhesive tape rolls 2, having a size to be accommodated within said pen casing 1, and being provided with sliding sleeves 21 at their central portion in a manner that said adhesive tape rolls 2 can rotate around said central shaft 5 independently with one another; and a rear cap 6, being provided with a gear thread 61 on its inside wall for engaging with a gear thread 52 on said central shaft 5 in a manner that said pen casing can be sealed and fixed and hence said adhesive tape roll 2 can be fixed. Further, the adhesive tape rolls can be mounted in clockwise or counterclockwise manner.

Figure 3:
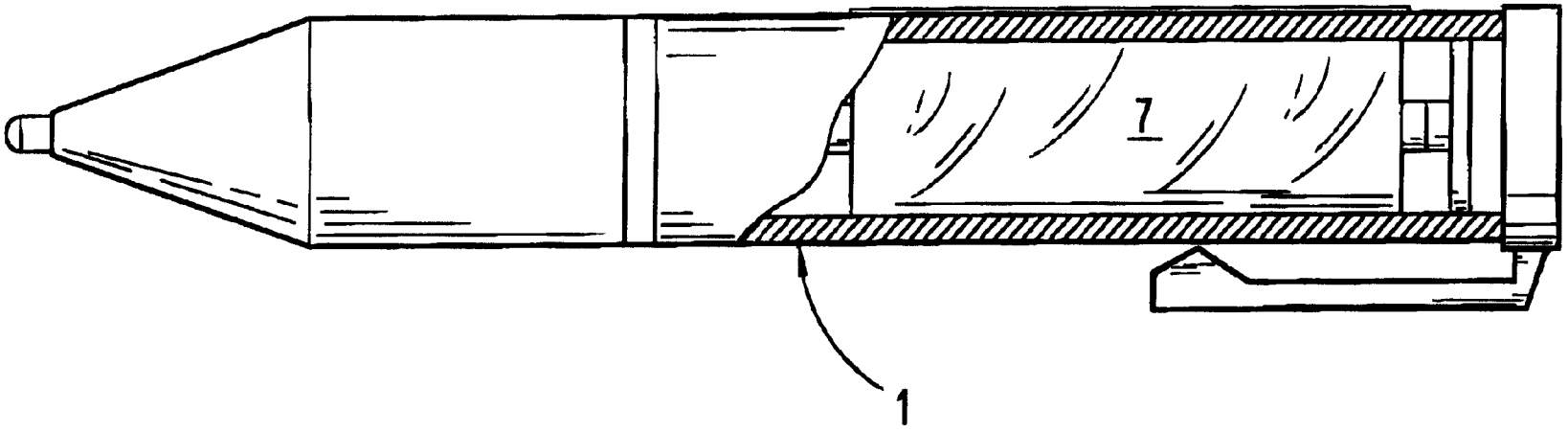
FIG. 3 is a schematic view showing another embodiment of the adhesive tape pen according to the invention.

The adhesive tape pen according to the invention is characterized mainly in that said adhesive tape roll is provided within the pen casing 1, and that said adhesive tape roll 2 can be in a variety of forms, such as, an adhesive tape in sheet form (FIG. 3), or several adhesive tapes (FIG. 1) each having different color or pattern, so that the pen is more attractive and stronger in its writing performance.

In the adhesive tape pen according to the invention, the front portion 4 has a length equal to that of the ink cartridge 3. Further, the central shaft 5 in the pen casing 1 is a separate part from said front portion 4 such that the rotational operation of said ink cartridge 3 will not affect the operation of said adhesive tape roll 2.

For the assembly of the above-mentioned constitutive elements, the male thread on the ink cartridge 3 is screwed on and engaged with the female thread on the inside edge of the front portion, then several adhesive tape rolls are slipped individually on the central shaft in a manner that said adhesive tape rolls can rotate smoothly, the central shaft together with said adhesive tape rolls is inserted in the pen casing with gear threads on the front and rear ends of the shaft engaging with the gear thread on the pen casing and with the gear thread on the rear cap, respectively, and finally, the rear cap is screwed on tightly to yield a portable adhesive tape pen.

Figure 4:
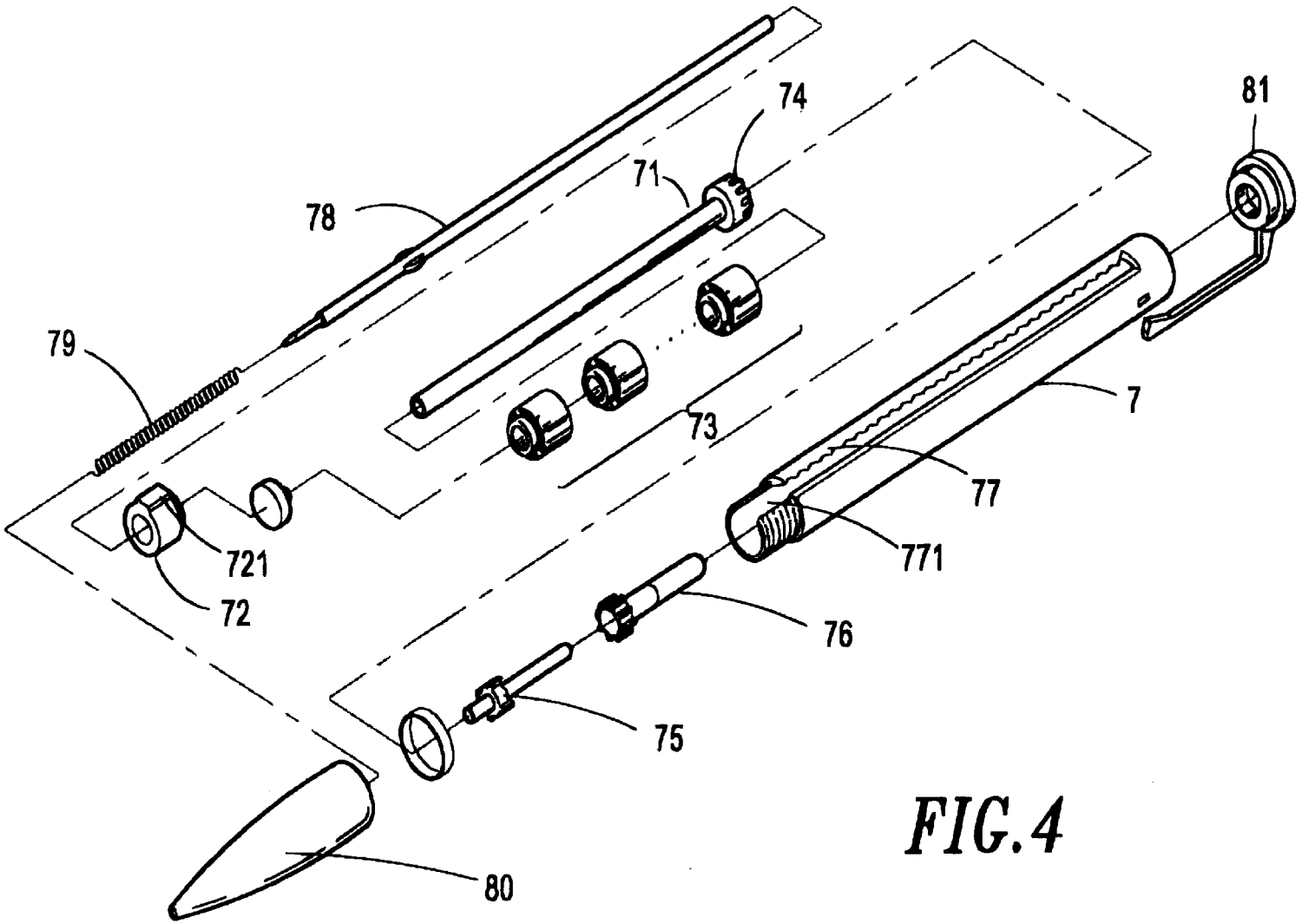
FIG. 4 is a view illustrating the manner of using the adhesive tape pen according to the invention.

Referring to FIG. 4, a schematic view illustrates another embodiment of the adhesive tape pen according to the invention, comprising a hollow rotational shaft 71, a hollow fixing seat 72, and adhesive tape rolls 73, wherein said hollow rotational shaft 71 is provided, on the upper portion thereof, with a ratchet 74, and a fixing shaft 75 and a pushing part $^{7}$6 are slipped on the upper part of said ratchet 74; the assembly of the above-described elements is inserted in a hollow pen casing 7 in a manner that said adhesive tape can be exposed out of said pen casing 7 through a slit 77 on said pen casing 7; wherein said hollow fixing seat 72 is provided with an engaging part 721, said engaging part 721 is inserted in a notch 771 provided on the lower end of said hollow pen casing 7; wherein the ink cartridge 78 together with the buffering spring 79 slipped on the front end of said ink cartridge 78 can penetrate into said pen casing through said hollow fixing seat 72 and said hollow rotational shaft 71, and through the engagement of a front portion 80 with said pen casing 7, said ink cartridge 78 can be fixed within said pen casing 7; and finally, the rear cap 81 is screwed on said pen casing. In this embodiment, said adhesive tape roll 73 can be, optionally, in an exchangeable or non-exchangeable form.

The adhesive tape pen according to the invention has the following advantages;

1. The inconvenience in the space-consumption and ease in loss associated with the carrying of several different stationeries can be avoided.
2. By comparing costs of two types of stationery, the increase of the production cost can be compensated in that the production time can be saved and production cost can be lowered.
3. For students, faculties on duty and those who use pen and stationery, the present invention provides an additional function and can improve the quality and efficiency.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An adhesive tape pen comprises:

a front portion, allowing an ink cartridge to expose its writing tip, and being provided with a female thread on its inside edge for engaging with a male thread provided on the ink cartridge such that said ink cartridge can expose its writing tip by means of a rotation device provided on said front portion;

a pen casing, in a form of a hollow tube, having a slightly outward protruding slit provided on an appropriate site thereof, and provided further with a gear thread on its front end;

a central shaft, being provided through the central portion of said pen casing and being used mainly for fixing adhesive tape rolls, wherein fixing gear threads are provided on both of its ends for engaging stably with said gear thread on said pen casing and with a gear thread on a rear cap, respectively, in order to provide a good operation situation for the user to draw out readily the adhesive tape;

said adhesive tape rolls each having a size to be accommodated within said pen casing, and being provided with a sliding sleeve at its central portion in a manner that said adhesive tape rolls can rotate around said central shaft independently with one another; and said gear thread of said rear cap being provided on an inside wall of said rear cap for engaging with said respective gear thread on said central shaft in a manner that said pen casing can be sealed and fixed and hence said adhesive tape rolls can be fixed.

2. An adhesive tape pen as recited in claim 1, wherein said adhesive tape rolls can be mounted within said pen casing in clockwise or counterclockwise manner.

3. An adhesive tape pen as recited in claim 1, wherein said rear cap has a structure that can be screwed off of said central shaft for changing conveniently said adhesive tape roll.

4. An adhesive tape pen, comprises at least:

a pen casing, in a form of a hollow tube, having a slightly outward protruding slit provided on an appropriate site thereof, and being provided further with a gear thread on its front end;

adhesive tape rolls, having a size to be accommodated within said pen casing, and being provided with sliding sleeves at their central portion in a manner that said adhesive tape rolls can rotate around a central shaft disposed within said pen casing independently with one another; and said central shaft being a hollow rotational shaft provided on an upper portion thereof with a ratchet, wherein a fixing shaft and a pushing part are slipped on an upper part of said ratchet;

wherein the assembly of the pen includes insertion of the tape rolls, the central shaft, the fixing shaft and the pushing part into said hollow pen casing in a manner that said adhesive tape on said rolls can can be exposed out of said pen casing through said slit on said pen casing; wherein a said hollow fixing seat is provided with an engaging part, said engaging part being inserted in a notch provided on a lower end of said hollow pen casing; wherein an ink cartridge, together with a buffering spring slipped on a front end of said ink cartridge, can penetrate into said pen casing through said hollow fixing seat and said hollow rotational shaft; and wherein, through the engagement of a front portion with said pen casing, said ink coolidge can be fixed within said pen casing.

* * * * *